United States Patent [19]

Wallover, III

[11] Patent Number: 4,642,960

[45] Date of Patent: Feb. 17, 1987

[54] PREFABRICATED BUILDING PANEL AND METHOD OF MAKING THE SAME

[76] Inventor: Edwin M. Wallover, III, 409—30th St. NW., Canton, Ohio 44709

[21] Appl. No.: 680,900

[22] Filed: Dec. 12, 1984

[51] Int. Cl.[4] ..... E04F 13/08; E04C 2/06; E04C 5/19

[52] U.S. Cl. ..... 52/390; 52/385; 52/389; 52/434; 52/602; 52/681; 52/683

[58] Field of Search ..... 52/434, 315, 385, 389, 52/390, 363, 344, 602, 681, 683, 125.4, 719, 664, 660; 245/8

[56] References Cited

U.S. PATENT DOCUMENTS

| | | | |
|---|---|---|---|
| 6,994 | 3/1876 | Jackson | 52/363 |
| 357,605 | 2/1887 | Kelly | 52/683 |
| 383,952 | 6/1888 | Hegbon | 52/681 |
| 1,767,565 | 6/1930 | Thrift et al. | 52/683 X |
| 1,822,781 | 9/1931 | McSkimming | 52/683 X |
| 1,933,237 | 10/1933 | Aberson | 52/385 |
| 2,039,098 | 4/1936 | Marks | 52/385 |
| 2,139,905 | 12/1938 | Meyrick | 52/389 |
| 2,162,861 | 10/1937 | Polak . | |
| 2,983,080 | 5/1961 | Whiteside | 52/385 |
| 3,142,938 | 8/1964 | Eberhardt | 52/385 |
| 3,245,185 | 4/1966 | Rowe | 52/315 |
| 3,515,611 | 6/1970 | Muhlberg et al. | 52/390 X |
| 3,622,656 | 11/1971 | Dewey, Jr. et al. . | |
| 3,775,916 | 12/1973 | Bair . | |
| 4,349,398 | 9/1982 | Kearns et al. . | |
| 4,472,919 | 9/1984 | Nourse | 52/344 X |

FOREIGN PATENT DOCUMENTS

| | | | |
|---|---|---|---|
| 64254 | 11/1982 | European Pat. Off. | 52/344 |
| 2038961 | 2/1972 | Fed. Rep. of Germany | 52/719 |
| 2141046 | 2/1973 | Fed. Rep. of Germany | 52/719 |
| 1821 | of 1910 | United Kingdom | 52/665 |

*Primary Examiner*—Alfred C. Perham
*Attorney, Agent, or Firm*—Sand & Hudak Co.

[57] ABSTRACT

An improved prefabricated building panel for mounting on the exterior of a building including a plurality of spaced, parallel support members or studs preferably formed by metal channels. A five strand layer wire mesh formed by a plurality of interwoven wires arranged at right angles to each other is attached to the support members and spaced therefrom by a plurality of spacers. The wire mesh is encapsulated with cement to form a ferrocement panel and decorative facing tile are secured to an outer face of the ferrocement panel by a layer of grouting. The ferrocement panel provides the structural load bearing component for the prefabricated panel for supporting the facing tile and eliminates the need for a separate substrate which heretofore spanned the support members and provided the structural support. The invention also includes the method steps for forming such a prefabricated panel.

20 Claims, 9 Drawing Figures

PREFABRICATED BUILDING PANEL AND METHOD OF MAKING THE SAME

TECHNICAL FIELD

The invention relates to building materials and in particular to prefabricated panels for use on the exterior of a building. More particularly, the invention relates to such a prefabricated building panel and method for making the same in which a cement encapsulated three-dimensional wire mesh provides the main structural support component of the panel on which the exterior facing bricks or tiles are attached.

BACKGROUND ART

Prefabricated panels have become increasingly popular in the building industry in order to provide a satisfactory structure which can be erected in less time and therefore reduced savings than prior conventional building materials and techniques. The panels can be mass produced remote from the actual construction site and then shipped to the site where they are erected on a structure frame work in a relatively short time. This enables the building to be enclosed more quickly than heretofore possible enabling the interior work to be begun earlier in the construction schedule. Thus, both the formation of the panels and their erection at the building site is less effected by inclement weather and surrounding conditions. Use of such prefabricated panels also eliminates the need for elaborate scaffolding and becomes very economical on buildings over several stories high.

Metal and precast concrete panels have been used in the construction industry for years and have been used for receiving, or having formed as a part thereof, an exterior surface of various types of materials in order to provide an attractive appearance for the building. Heretofore, the basic components of these prior prefabricated panels are a steel stud framing with a gypsum sheeting attached thereto with an outer or intervening layer of insulation. A thin veneer coat of synthetic plaster or Portland cement is applied to the gypsum sheeting and a reinforcing mesh of wire or fabric is embedded in the veneer. These prior panels did provide improved thermal properties and were lightweight and low in cost. In these prior prefabricated panels and systems using a coat of mortar or cement in combination with a wire or fabric mesh, the mortar coat is always attached to or mounted on a structural sub-base such as a gypsum sheet or other type of sheeting which in turn is attached to the spaced frame members or studs. This provided a multilayer system having problems with respect to water intrusion, delamination and differential thermal expansion and contraction.

Also, the methods or sequence of steps for fabricating such prior panels, although reducing the amount of time for erecting the same in contrast to forming the resultant structure on the job site, still requires more time than desirable in order to reduce the cost. In these prior prefabricated panels, the supporting substrate or gypsum sheet is attached to the spaced frame members by the use of self tapping sheet metal screws. Next an expanded stamped metal lath is attached to the gypsum sheet with self tapping sheet metal screws. Then a coating of Portland cement is applied over the metal lath, and after drying a thin leveling coat is added. In the final step a layer of grout or setting bed is applied for attaching the tile. However, the resulting mesh reinforced cement was always supported by the sheeting. Next, a layer of mortar or grouting is applied to the outer surface of the cement for securing facing brick, tile or the like thereon.

Therefore, there is a need for an improved prefabricated panel and method of making the same which eliminates the problems encountered with prior prefabricated panels which use a separate structural element on which the mesh encapsulating mortar or cement is attached. There is no known prefabricated panel construction and method of making the same of which I am aware which eliminates these problems by using an encapsulated three dimensional wire mesh as a structural member which is attached directly to the metal frames or studs for mounting the facing tile or brick thereon.

DISCLOSURE OF THE INVENTION

Objectives of the invention include providing an improved prefabricated panel construction in which a three dimensional wire mesh is encapsulated in Portland cement or other types of mortar and functions as the structural element of the panel for supporting a desired type of facing material, and in which the encapsulated three dimensional mesh is attached to a plurality of support members, preferably metal channels, and is spaced from the panels by a plurality of spacing discs. Another objective is to provide such an improved panel in which the encapsulated wire mesh may be separated from the metal support channels by a sheet of flexible thermal insulation or individual strips of thermal material attached to the mounting edge of the channels to reduce the effects of expansion and contraction of the supporting steel frame work with respect to the cement encapsulated wire mesh. Such strips are for insulation purposes only.

A still further objective of the invention is to provide such an improved prefabricated panel in which the three dimensional wire mesh provides an effective thickness of five wire strand layers which enables the encapsulating cement to completely fill the interstices between the spaced wire strands firmly encapsulating the mesh therein and building up a pair of layers on opposite sides of the wire mesh to a desired thickness to form a ferrocement panel which is mounted by metal fastening screws onto the spaced support members.

Another objective of the invention is to provide such a prefabricated panel in which the strands of the encapsulated wire mesh are galvanized to prevent rusting and possible bleeding through the encapsulating cement, and in which the cement preferably is Portland cement or a polymer impregnated mortar or the like. A further objective is to provide such a prefabricated panel in which the wire mesh is comprised of a plurality of spaced straight wire strands having two layers of spaced shoot wire strands extending transversely thereto and clamped against the straight wire strands by intervening crimp wire strands interlaced in a saw tooth arrangement and alternating between upper and lower levels of shoot wire strands.

A still further objective of the invention is to provide an improved method for producing the prefabricated panel at a reduced cost, and in which the panel is lighter weight than prefabricated panels produced by known methods and materials and which is less susceptible to delamination and water leakage. Another objective is to provide such an improved prefabricated panel in which the facing material that is attached by grouting to the ferrocement panel may be ceramic tile or other weather resistant, attractive brick or similar material.

These objectives and advantages are obtained by the improved prefabricated exterior building panel of the invention, the general nature of which may be stated as including a prefabricated exterior building panel including a plurality of spaced parallel elongated support members; a plurality of spacers attached to the support members; a wire mesh attached to the support members and spaced from said members by the spacers, said mesh being formed by a plurality of interwoven spaced wires arranged at generally right angles providing interstices therebetween and with the total thickness of the mesh consisting of the thickness of five wire strand layers; a layer of cement generally encapsulating the wire mesh; a layer of grouting applied to the encapsulated wire mesh; and a plurality of facing elements attached to the encapsulated wire mesh by the grouting.

These objectives and advantages are further obtained by the improved method of forming the improved prefabricated exterior building panel of the invention, the general nature of which may be stated as including the steps of arranging a plurality of elongated support members in a parallel spaced relationship; attaching a plurality of spacers on each of the support members; securing a wire mesh to the support members spaced from said members by the spacers, said mesh being formed by a plurality of interwoven spaced wire strands arranged at right angles providing interstices therebetween whereby the total thickness of the mesh consists of the thickness of five wire strand layers; encapsulating the wire mesh with cement; applying a layer of grouting to an outer surface of the encapsulated wire mesh; and attaching a plurality of facing elements to the encapsulated wire mesh by the grouting.

BRIEF DESCRIPTION OF THE DRAWINGS

A preferred embodiment of the invention, illustrative of the best mode in which applicant has contemplated applying the principles, is set forth in the following description and is shown in the drawings and is particularly and distinctly pointed out and set forth in the appended claims.

Similar numerals refer to similar parts throughout the drawings.

BEST MODE FOR CARRYING OUT THE INVENTION

Figure 1:
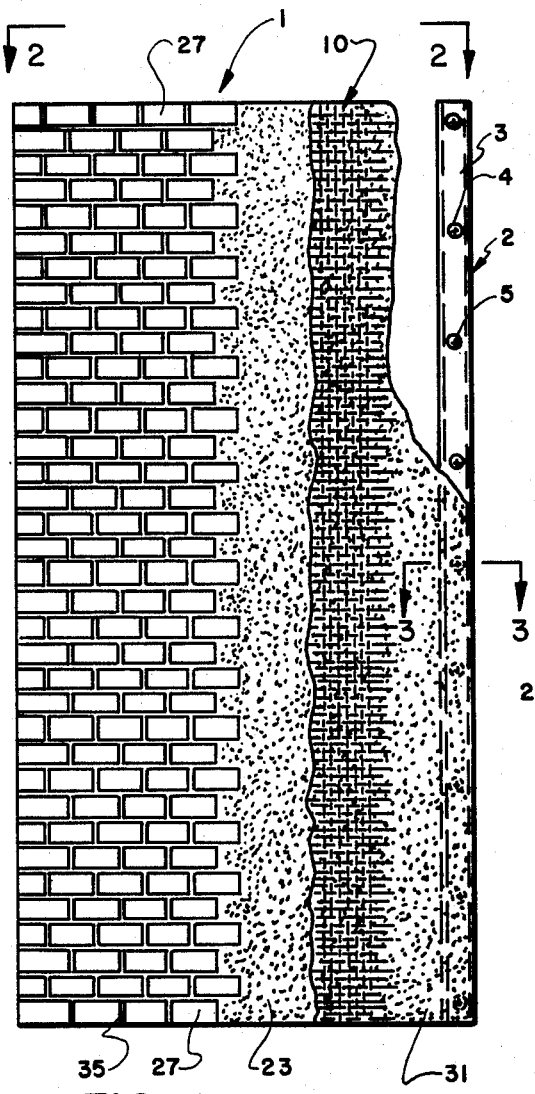
FIG. 1 is a plan view with portions broken away of the improved prefabricated panel with the individual components thereof shown in a layered arrangement.
Figure 2:
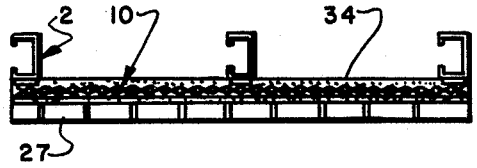
FIG. 2 is a top plan view looking in the direction of arrows 2—2, FIG. 1.
Figure 5:
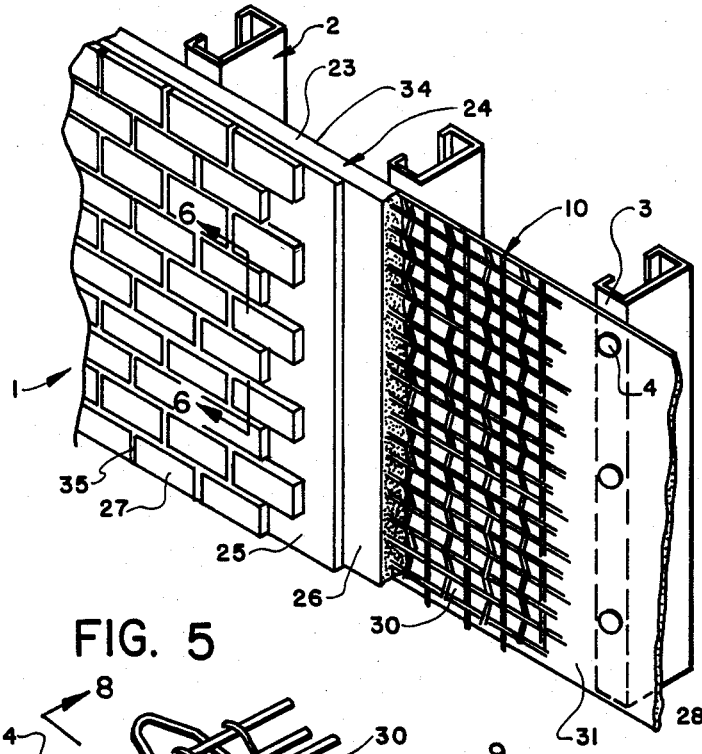
FIG. 5 is a fragmentary perspective view with portions broken away and in section of the improved prefabricated panel.

The improved building panel construction for use on the exterior of buildings is indicated generally at 1, and is best illustrated in FIGS. 1 and 5 in a broken away, layered construction. Panel 1 includes a plurality of horizontally spaced, vertically extending support members or studs 2, preferably formed of steel channels. Frame members 2 will have generally flat front attachment surfaces 3. In certain applications, a flexible sheet of thermal insulating material or a vapor barrier (not shown) may be attached to and extend between spaced frame members 2, or a single strip of insulating material may be attached to and extend along front surface 3 of each member 2.

Figure 3:
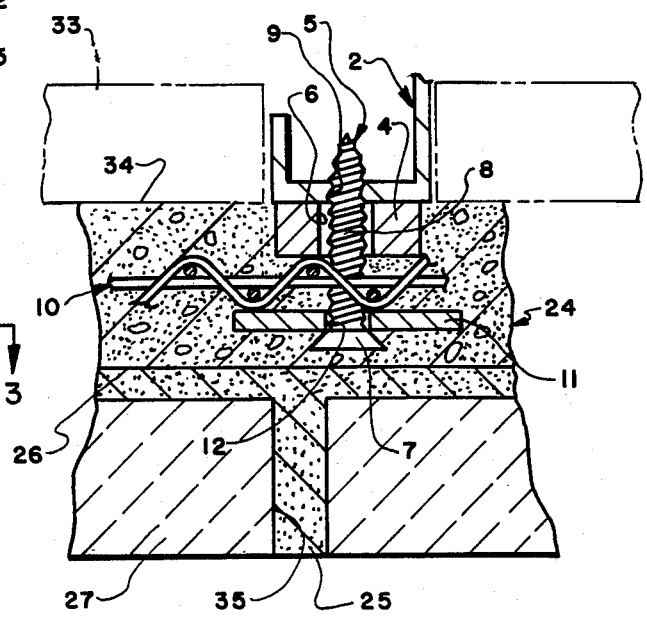
FIG. 3 is an enlarged fragmentary sectional view taken on line 3—3, FIG. 1.
Figure 4:
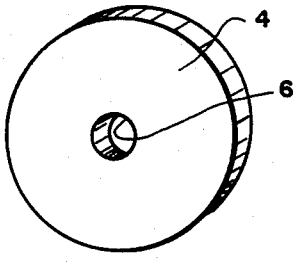
FIG. 4 is an enlarged perspective view of one of the spacer discs.

A plurality of spacers 4 (FIG. 4) are attached to front surfaces 3 of channels 2 as shown in FIGS. 3 and 5 by self-threading metal screws or a waterproof construction adhesive. Spacers 4 preferably are disc-shaped and are formed of a plastic or metal material and have a central hole 6 through which screws 5 project. Screws 5 preferably have a conical head 7 and a threaded shank 8 which self threads through a hole 9 in surface 3 of support member 2.

Figure 7:
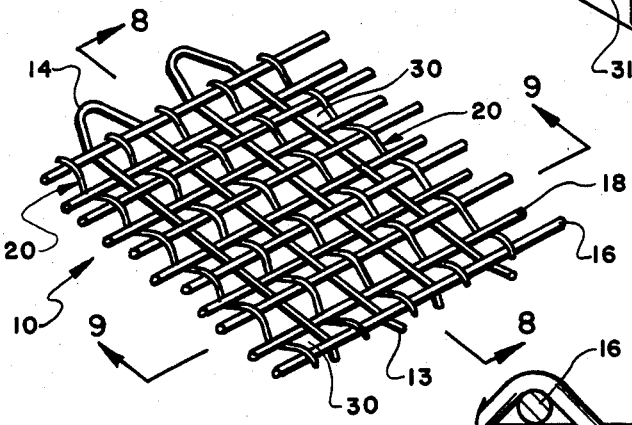
FIG. 7 is a fragmentary perspective view of the wire mesh component of the improved panel.

In accordance with one of the main features of the invention, a three-dimensional wire mesh indicated generally at 10 (FIGS. 7-9) is attached by metal screws 5 (FIG. 3) or other types of fasteners to channels 2 and are spaced from channel surfaces 3 by spacers 4. A washer 11 is formed with a central hole 12 through which screw shaft 8 extends and is clamped against wire mesh 10 by conical head 7 of screw 5.

Figure 8:
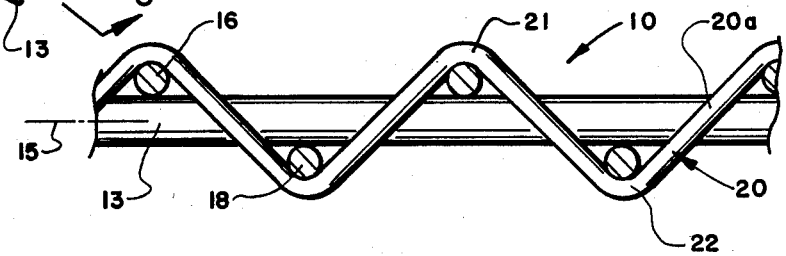
FIG. 8 is a greatly enlarged fragmentary sectional view taken on 8—8, FIG. 7.
Figure 9:
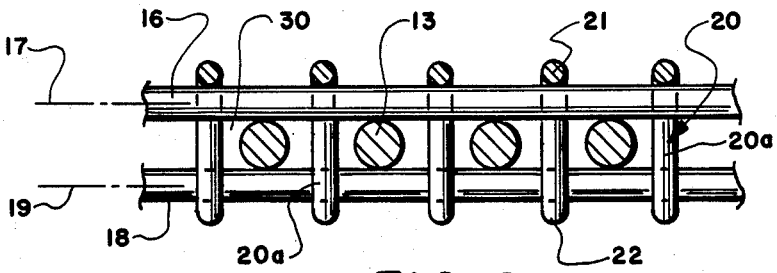
FIG. 9 is a greatly enlarged fragmentary sectional view taken on line 9—9, FIG. 7.

Mesh 10 preferably consists of three different size wire strands which are arranged in various layers at generally right angles with respect to each other. Preferably each of these wire strands have a circular cross sectional configuration. The largest diameter strand is referred to as the straight strand and is indicated at 13 in the drawings. A plurality of straight strands 13 lie in a spaced parallel relationship with respect to each other in a common plane 15 (FIGS. 8 and 9). The ends of individual wire strands 13 may be connected at 14 at the ends of individual sections of wire mesh 10.

A plurality of second spaced wire strands preferably of a smaller diameter and referred to as the shoot strands indicated at 16, extend at right angles with respect to straight strands 13 and lie in a common plane 17 parallel with plane 15. Another plurality of spaced parallel shoot strands indicated at 18, also extend at right angles with respect to straight strands 13 and form another layer of wires on the opposite side of straight strands 13 from shoot strands 16 in a plane 19 which is parallel with planes 15 and 17. The layers of shoot strands 16 and 18 are clamped against straight strands 13 by a plurality of spaced crimp strands 20. Strands 20 are interwoven with the two layers of shoot strands 16 and 18 and extend in a sawtooth configuration parallel with straight strands 13 with each crimp wire strand 20 being located between a pair of straight strands 13. The sawtooth configuration of crimp wire strands 20 includes a straight section 20a extending between corners 21 and 22.

This arrangement forms an extremely strong wire mesh having a three dimensional effect and provides in cross section a mesh having five wire layers as shown in FIGS. 8 and 9. These layers consist of the central layer (plane 15) formed by straight wire strands 13, the two opposed layers (planes 17 and 19) formed by spaced shoot strands 16 and 18 located on opposite sides of strands 13, and the two outermost layers formed by corners 21 and 22 of orimp wire strands 19 as the crimp wire strands extend about each shoot warp strand 16 and 18. These various spaced wire strands form generally rectangular shaped interstices 30 when viewing mesh 10 in plan view and preferably will be galvanized to prevent rusting and possible bleeding through to the exterior of the panel.

One type of such three dimensional wire is distributed by Ferrocement Developement Corporation of Latrobe, Pa. under its trademark, Pancon. In the preferred embodiment straight wire strands will have a diameter of 0.072 inches, the shoot wire strands will have a diameter of 0.067 inches, and the crimp wire strands will have a diameter of 0.047 inches.

Figure 6:
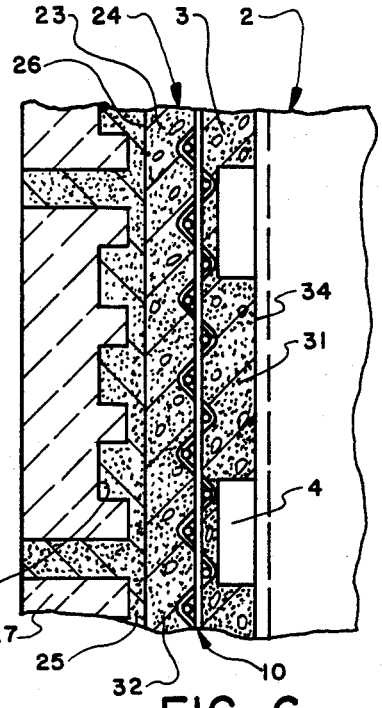
FIG. 6 is an enlarged fragmentary sectional view taken on line 6—6, FIG. 5.

In accordance with another feature and step of the invention, wire mesh 10 is encapsulated with a mortar preferably, latex modified, polymer impregnated, or certain types of Portland cement 23 to form a ferrocement panel indicated generally at 24, consisting of wire mesh 10 and encapsulating cement 23. Cement 23 will completely encapsulate wire mesh 10 and will flow through the interstices 30 formed between the wire strands forming layers 31 and 32 on opposite sides of mesh 10 (FIG. 6). In the preferred embodiment, wire mesh 10 will have a thickness of approximately $\frac{1}{4}$ inch with each encapsulating cement layer 31 and 32 having a thickness measured by the distance beyond the crimp wire corners 21 and 22 of approximately $\frac{1}{4}$ inch to form ferrocement panel 24. In the forming of panel 24, concrete retention forms of other types of backing boards as shown by dot-dash lines 33 in FIG. 3, may be inserted between support members 2 in order to provide the containment when pouring the cement, and which forms inner surface 34 of panel 24. Forms or backing boards 33 may be sheets of insulation material which remain in place between support members 2 to provide a thermal insulation barrier for the formed prefabricated panel 1 when completed and assembled.

Next a layer of grout 25 is applied over the front surface or face 26 of ferrocement panel 24 (FIGS. 3 and 6) and a plurality of facing bricks or tiles 27 which are back buttered or have grooved back surfaces 28 to provide a satisfactory bonding surface for adhereing strongly to grouting 25. Facing bricks 27 may be ceramic tile or other types of weather resistänt materials which provides an attractive exterior appearance to the building.

In improved panel 1 ferrocement panel 24 becomes the structural component of the completely prefabricated panel which supports and mounts exterior facing bricks 27 thereon and which is attached to the supporting frame members 2 by screws 5. This construction is in contrast to prior prefabricated panels in which a separate substrate, usually formed of gypsum board or similar type of sheeting material, is attached to channel members 2 and the mesh reinforced cement or mortar is then attached to the sheeting. In this prior construction, the sheeting became the structural member on which the mesh reinforced cement, grout and attached facing brick supported. It is this prior type of construction which is subject to delamination, water instrusion and different thermal expansion and contraction effects which is considerably improved in both performance and cost of manufacture by improved panel 1.

Prefabricated panel 1 is constructed by an improved method which reduces both time and the amount of materials heretofore required for production of prior prefabricated panels. The steps of the improved method include providing a plurality of support frame members 2 which are arranged in a parallel spaced relationship. Next one or more sections of wire mesh 10 are attached to support members 2 and extend between and across faces 3 thereof by fastening screws 5 as shown in FIG. 3. The mesh is clamped tightly against spacers 4 which are spaced along the length of face 3 of support members 2 as shown in FIG. 1 at approximately 18 inch intervals. As discussed above, a form or backing board 33 will be located between the adjacent support members 2 to provide the concrete containment and which forms inside surface 34 of ferrocement panel 24.

After securely fastening mesh sheets 10 to support members 2 Portland cement 23 or a polymer impregnated mortar is poured or troweled onto mesh 10 where it will flow through interstices 30 to form equal thickness layers 31 and 32 on the sides of mesh 10. After cement 23 has sufficiently dried to form ferrocement panel 24, a layer of grouting 25 is applied to outer surface or face 26 of ferrocement panel 24. Facing bricks 27 then are placed in a spaced relationship in grouting 25 with grout receiving spaces 35 being provided therebetween (FIG. 3).

As soon as grouting 25 has dried sufficiently to secure facing bricks 27 in position on ferrocement panel 24, panel 1 is ready for transport to a construction site, or if formed at the construction site it can be raised into position by a crane or other type of lifting equipment. Panels 1 can be attached easily to the main framework of the building by various types of attachment clips well known in the construction industry.

Tests on the prefabricated panels show that a better balance is achieved between load resistance when the facing tiles or bricks 27 are on the tension side of a bending force when spacers 4 are used instead of mounting the ferrocement panels directly to front faces 3 of support members 2. Preferably wire mesh sections 10 as well as prefabricated panels 1 are formed in sections between $4' \times 8'$ and $4' \times 15'$. Prefabricated panel 1 has the toughness and ductility characteristic of ferrocement and provides a strong waterproof and fire resistant structure. The use of ferrocement panel 24 as the load bearing element eliminates the need for a separate panel of gypsum or the like heretofore used for the load bearing element. In prior prefabricated panels using steel mesh, it was used as a means for fastening or securing the mortar to the structural sub-base or sheeting in an attempt to reduce the possiblity of delamination since the structural strength was provided by the sub-base material itself.

Tests have been performed on 16 inch long samples of improved panel 1 which have a total thickness of approximately $1\frac{1}{4}$ inches. A sustained load of 800 pounds was placed on the panels in a positive bending with the ceramic tile or brick surface being in compression resulting in a total deflection of 0.8 inches and outer facing tiles or bricks 27 were not dislodged or sheared off by such extreme bending and sustained load. The strength provided by such panels is far greater than that required by any building code and forms a very effective and durable prefabricated panel. Furthermore, the elimination of the heretofore sub-structural sheets or base, in addition to reducing material cost, reduces fabrication cost by eliminating this additional step of handling and attaching the sub-based sheet to the studs or support members 2.

Accordingly, the improved prefabricated panel construction 1 and method of making the same provides a panel which is lighter in weight than known panels of comparable structural strength and component makeup, reduces the cost of fabricating the panels, and eliminates the heretofore serious problem of water leakage and delamination caused by the use of a separate sub-base for the supporting structure, and reduces the thermal expansion and contraction experienced by such sub-base supported panel configurations.

Accordingly, the improved prefabricated panel construction and method is simplified, provides an effective, safe, inexpensive, and efficient device and method of making the same which achieves all the enumerated objectives, provides for eliminating difficulties encountered with prior devices and methods, and solves problems and obtains new results in the art.

In the foregoing description, certain terms have been used for brevity, clearness and understanding; but no unnecessary limitations are to be implied therefrom beyond the requirements of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved prefabricated exterior building panel and method of making the same is constructed and carried out, the characteristics of the construction and method, and the advantageous, new and useful results obtained; the new and useful structures, devices, elements, arrangements, parts, combinations, and method steps, are set forth in the appended claims.

What is claimed is:

1. A prefabricated exterior building panel including:

(a) a plurality of spaced parallel elongated support members;

(b) a plurality of spacers attached in a spaced relationship to the support members;

(c) a wire mesh attached to the support members and spaced a predetermined distance from said members by the spacers, said mesh being formed by a plurality of interwoven spaced wires arranged at generally right angles providing interstices therebetween and with the total thickness of the mesh consisting of the thickness of five wire strand layers;

(d) a generally planar layer of cement generally encapsulating the wire mesh and having an outer surface and an opposite inner surface with said inner surface abutting the support members;

(e) a layer of grouting applied to the outer surface of the encapsulating cement; and (f) a plurality of facing elements attached to the outer surface of the cement by the grouting.

2. The building panel defined in claim 1 in which the support members are horizontally spaced, vertically extending metal channels.

3. The building panel defined in claim 1 in which the spacers are disc-shaped members formed of steel or plastic.

4. The building panel defined in claim 3 in which the spacers are attached to the support members by metal fasteners.

5. The building panel defined in claim 4 in which the metal fasteners are self-threading screws and have a washer which clamps against the wire mesh.

6. The building panel defined in claim 1 in which the encapsulating cement is Portland cement.

7. The building panel defined in claim 1 in which the wire mesh is galvanized.

8. The building panel defined in claim 1 in which the facing elements are ceramic tile blocks.

9. The building panel defined in claim 1 in which the wire mesh includes four series of wire strands interwoven in a spaced relationship, namely, a crimp strand, a straight strand and a pair of shoot strands; and in which said strands are circular in cross section.

10. The building panel defined in claim 9 in which the straight strand has the largest diameter of the three strands; in which the straight strands are parallel to each other and lie in a common plane; in which the shoot strands lie in alternating relationship in two separate parallel layers with the straight strands being located therebetween; and in which the crimp strands are interwoven between the two layers of the shoot strands clamping the shoot strands against the straight strands.

11. The building panel defined in claim 10 in which the diameter of the straight strands, shoot strands and crimp strands are 0.072 inches, 0.067 inches and 0.047 inches respectively.

12. The building panel defined in claim 10 in which the crimp strands form generally saw tooth configurations in interweaving between the two layers of shoot strands being defined by angled corners connected by straight segments; and in which the mesh has a five wire strand thickness defined by adjacent corners of the crimp wire strands, the pair of spaced shoot wire strands and the straight wire strand which forms the center wire strand of the mesh.

13. The building panel defined in claim 1 in which the facing elements are formed with grooved back surfaces.

14. A prefabricated exterior building panel including:

(a) a plurality of spaced parallel elongated support members;

(b) a plurality of spacers located at spaced intervals along the support members;

(c) a wire mesh attached to the support members and spaced from said members by the spacers, said mesh being formed by a plurality of interwoven spaced wires arranged at generally right angles providing interstices therebetween and with the total thickness of the mesh consisting of the thickness of five wire strand layers;

(d) a plurality of fasteners attaching the spacers and wire mesh at spaced intervals to the support members;

(e) a layer of cement generally encapsulating the wire mesh;

(f) a layer of grouting applied to the encapsulated wire mesh; and (g) a plurality of facing elements attached to the encapsulated wire mesh by the grouting.

15. A method of forming an exterior building panel including the steps of:

(a) arranging a plurality of elongated support members in a parallel spaced relationship;

(b) attaching a plurality of spacers on each of the support members;

(c) securing a wire mesh to the support members spaced a predetermined distance from said members by the spacers, said mesh being formed by a plurality of interwoven spaced wire strands arranged at right angles providing interstices therebetween whereby the total thickness of the mesh consists of the thickness of five wire strand layers;

(d) encapsulating the wire mesh with a generally planar layer of cement providing an outer surface and an opposite inner surface with said inner surface abutting the support members;

(e) applying a layer of grouting to the outer surface of the encapsulating cement; and (f) attaching a plurality of facing elements to the grouting.

16. The method defined in claim 15 in which the spacers and wire mesh are attached to the support members by metal fasteners.

17. The method defined in claim 16 in which the metal fasteners are self-threading screws; in which a washer is mounted on each of the screws and clamps the mesh against the spacers; and in which the screws extend through holes formed in the spacers and into other holes formed in the support members.

18. The method defined in claim 15 in which the wire mesh has a thickness of approximately $\frac{1}{4}$ inch; and in which the mesh is encapsulated between layers of concrete each approximately $\frac{1}{4}$ inch thick forming a ferrocement panel of approximately $\frac{3}{4}$ inch thick.

19. The method defined in claim 15 in which the strands of the wire mesh are galvanized.

20. A method of forming an exterior building panel including the steps of:

(a) arranging a plurality of elongated support members in a parallel spaced relationship:

(b) placing a plurality of spacers at spaced intervals along each of the support members;

(c) attaching the spacers and a wire mesh to the support members with a plurality of fasteners with the wire mesh being spaced from said support members by the spacers, and with said mesh being formed by a plurality of interwoven spaced wire strands arranged at right angles providing interstices therebetween whereby the total thickness of the mesh consists of the thickness of five wire strand layers;

(d) encapsulating the wire mesh with cement;

(e) applying a layer of grouting to an outer surface of the encapsulated wire mesh; and (f) attaching a plurality of facing elements to the encapsulated wire mesh by the grouting.

* * * * *